US009151008B1

(12) United States Patent
Carstens

(10) Patent No.: US 9,151,008 B1
(45) Date of Patent: Oct. 6, 2015

(54) WAVE BREAK DEVICE

(71) Applicant: Robin G Carstens, South Bend, IN (US)

(72) Inventor: Hazelton W Carstens, South Bend, IN (US)

( * ) Notice: Subject to any disclaimer, the term of this patent is extended or adjusted under 35 U.S.C. 154(b) by 0 days.

(21) Appl. No.: 14/466,247

(22) Filed: Aug. 22, 2014

(51) Int. Cl.
*E02B 3/04* (2006.01)

(52) U.S. Cl.
CPC ..... *E02B 3/04* (2013.01)

(58) Field of Classification Search
CPC ..... E02B 3/04; E02B 3/06
See application file for complete search history.

(56) References Cited

U.S. PATENT DOCUMENTS

| | | | | | |
|---|---|---|---|---|---|
| 919,788 | A * | 4/1909 | Smith | 405/31 |
| 1,375,232 | A * | 4/1921 | Rush | 405/31 |
| 3,618,327 | A * | 11/1971 | Frein et al. | 405/205 |
| 3,845,630 | A * | 11/1974 | Karnas | 405/30 |
| 3,913,333 | A * | 10/1975 | Hubbard, Jr. | 405/31 |
| 4,498,805 | A * | 2/1985 | Weir | 405/31 |
| 4,666,334 | A * | 5/1987 | Karaus | 405/31 |
| 4,818,141 | A * | 4/1989 | Rauch | 405/30 |
| 4,836,709 | A * | 6/1989 | Ploeg et al. | 405/31 |
| 4,913,595 | A * | 4/1990 | Creter et al. | 405/30 |
| 5,174,681 | A * | 12/1992 | Atkinson et al. | 405/34 |
| 7,029,200 | B1 * | 4/2006 | Cravens | 405/30 |
| 8,585,318 | B1 * | 11/2013 | Walker | 405/21 |
| 2003/0072615 | A1 * | 4/2003 | Woodall et al. | 405/25 |
| 2003/0147696 | A1 * | 8/2003 | Hulsemann et al. | 405/21 |
| 2011/0236132 | A1 * | 9/2011 | Wisegerber et al. | 405/30 |
| 2013/0322966 | A1 * | 12/2013 | Nettles | 405/21 |
| 2014/0314484 | A1 * | 10/2014 | Pierce, Jr. | 405/31 |

* cited by examiner

*Primary Examiner* — Benjamin Fiorello
(74) *Attorney, Agent, or Firm* — Botkin & Hall, LLP

(57) ABSTRACT

A device for dispersing wave energy is provided with a series of surfaces for redirection of approaching waves. The device has curved major surfaces that extend from the top to the bottom, each of the surfaces has stacked scallops that are angled downward to direct approaching waves downward. The curved major surfaces direct wave energy to become more parallel to a shore.

20 Claims, 7 Drawing Sheets

WAVE BREAK DEVICE

BACKGROUND OF THE INVENTION

This present disclosure relates to devices to disperse the energy from waves, particularly ones that cause erosion and damage to structures located near coastlines. Bodies of water are influenced by many factors: wind, currents, weather patterns, and storms. These factors can create waves that can contain a significant amount of energy. It is not uncommon for a large storm to cause large and powerful waves that cause erosion. In extreme cases, excavation equipment must be brought in to restore a shore or geographic markers need to be changed to reflect the altered shore. Because the sources of waves are beyond control, a practical alternative is needed to dissipate the energy contained in waves before it can damage a shore. Other wave break devices exist, but they are frequently completely submerged or take up the entire shore, rendering access to the beach difficult or impossible. An improved wave break device is needed.

SUMMARY OF THE INVENTION

The present disclosure describes a particularly useful device for dispersing the energy from waves crashing into a coastline from a body of water. Bombardment of waves can result in undesired coastline changes and erosion. Due to the high value of coastline property and cost of structures that are built in close proximity to a coastline, there is significant interest in the preservation of a coastline. Coastline changes can result in costly land disputes, destruction, movement, or rebuilding of homes and buildings that are in close proximity to the coastline. It is the purpose of this device to disperse the energy from the wave in order to reduce or prevent coastline changes and erosion. By dispersing much of the wave's energy before it reaches the shore, it reduces the amount of energy that the shore has to absorb.

The present invention involves placing a series of columns in a body of water, setting them deep enough to maintain stability, and having enough height so that the highest wave will still make contact with the column. The column has 4 sides, a top, and a bottom. The sides are curved inward towards the center of the column and each side has scallops that are at an angle to the central axis of the column. With the inward curve of the sides and the scallops, it is the intention of this invention that the energy from a wave will be dispersed in such a way that causes minimal impact to a shore.

BRIEF DESCRIPTION OF THE DRAWINGS

A preferred embodiment of this invention has been chosen wherein.

DESCRIPTION OF THE PREFERRED EMBODIMENT

Figure 1:
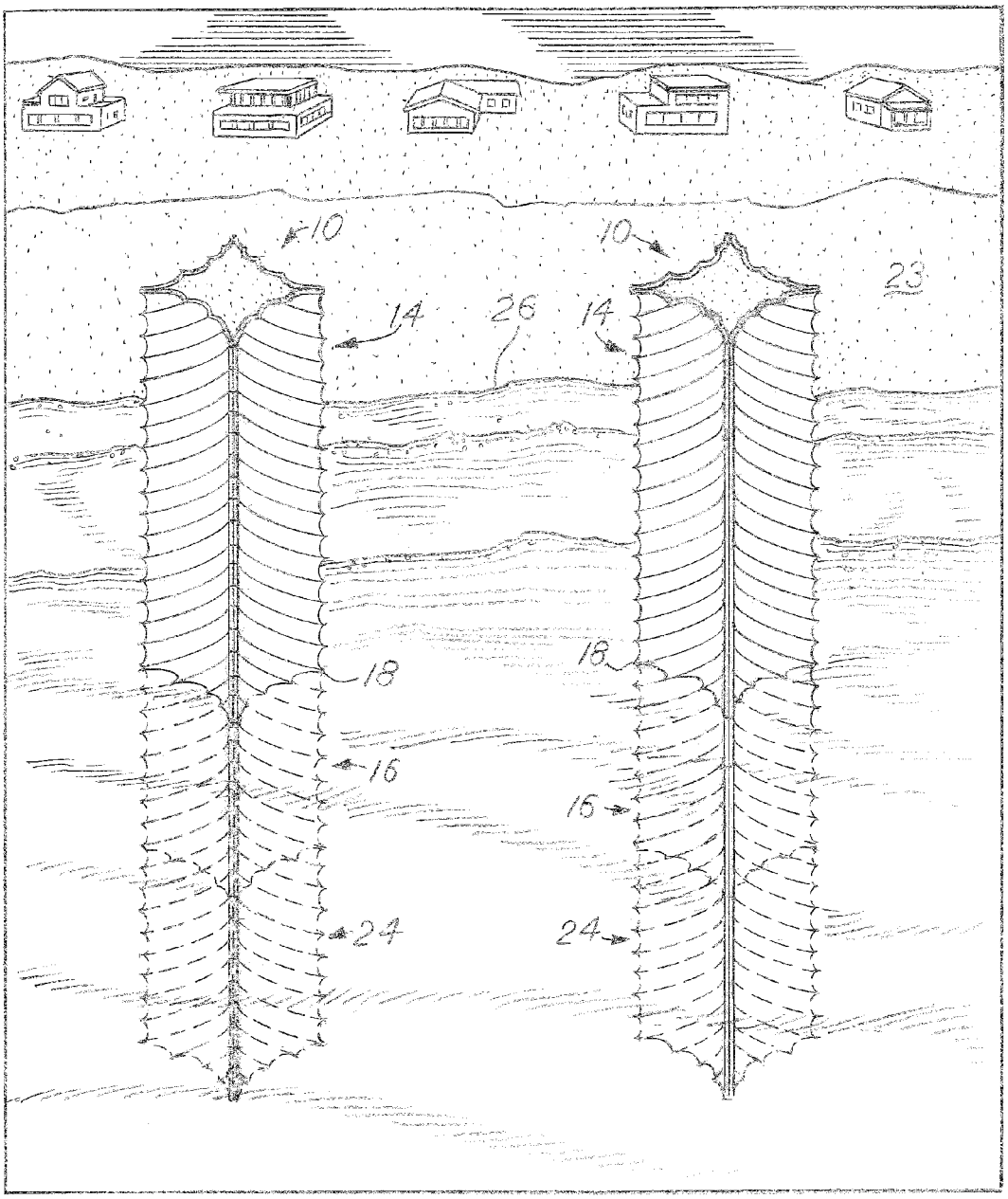
FIG. 1 is an isometric view of the device as it is installed.

For the purposes of this specification, a body of water 22 has a shore 26. The ground that is above the waterline is 23 and the ground below the waterline is 12, FIG. 4A. FIG. 1 shows the device 10, a column of rigid material as fixed in the ground 12 where a top portion 14 is exposed above the waterline 18. The device 10 has three vertical portions when it is installed. The device 10 is mounted where a lowest portion 24 is buried in the ground 12, a middle portion 16 is in contact with water 22, and the top portion 14 is above the water. The lowest portion 24 is affixed below the ground 12 and secured thereto. The middle portion 16 is below the waterline 18 and above the ground 12. The highest portion 14 is above the waterline 18. The device 10 is designed to disperse energy from waves coming to shore from a body of water 22. Frequently, multiple devices 10 as shown in FIG. 1 are installed in close proximity to a shore 26 to disperse wave energy. The spacing between each device 10 is dependent on the type and amount of wave energy being dispersed, the spacing to the shore 26, and the depth of water where the device 10 will be installed. The size of the device 10 is scalable based on the requirements of the environment. The device 10 can be mounted directly into the ground 12 or in another medium to fix their position. A horizon 20 is inward of the body of water and away from the shore 26. Waves 28 originate from the body of water and move from the horizon 20 to the shore 26.

Figure 2:
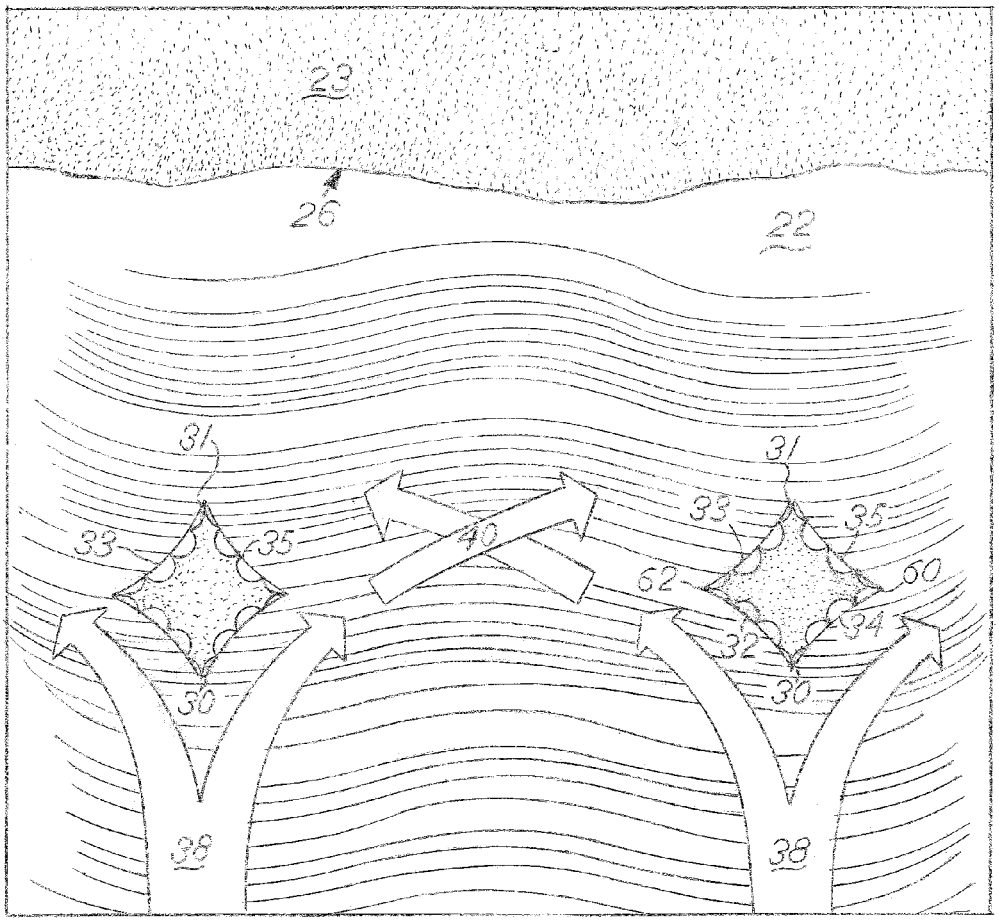
FIG. 2 is top view of the device showing how wave energy is dispersed.
Figure 3:
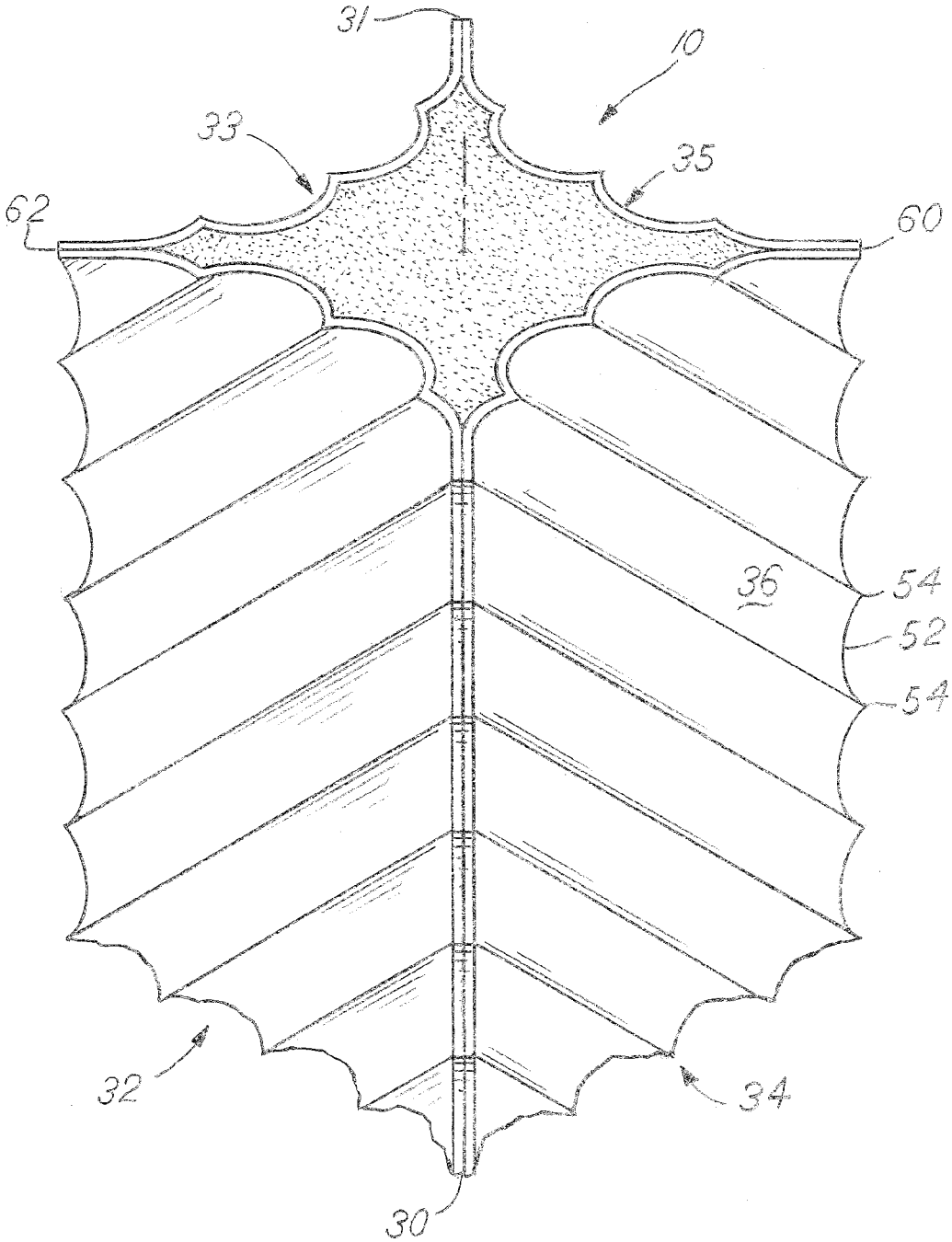
FIG. 3 close-up isometric view showing the detail of the scallops.

The device 10 is an elongate member with a central axis. In the embodiment shown in all FIGS, there are four major surfaces 32, 33, 34, and 35. Each major surface is concavely curved toward the central axis of the device. The surfaces 32, 33, 34, 35 are sized and shaped similarly to form four major edges 30, 31, 60, and 62, FIGS. 2 and 3. The four major edges 30, 31, 60, and 62 are parallel to and can be equally spaced from the central axis to form a roughly square perimeter shape with inwardly curved sides as shown in FIG. 3. However, other shapes are possible. It is possible to have three major edges, creating three major surfaces. As shown in FIG. 2, an approaching face is made up of two major surfaces 32 and 34. Major surfaces 32, 34 intersect to form major edge 30, also referred to as a leading edge. Correspondingly, a retreating face is made up of major surfaces 33 and 35 as shown in FIG. 3. Major surfaces 33, 35 meet to form a shore-facing edge 31. Where major surface 34 meets major surface 35, a right major edge 60 is formed. Where major surface 32 meets major surface 33, a left major edge 62 is formed. Major edges, also referred to as trailing edges, 60 and 62 are adjacent to major or leading edge 30. The four major surfaces 32, 33, 34, 35 have a series of inverted scallops 36, FIG. 3. The scallops have parallel adjacent lateral edges 54 that are angled with respect to the major edges. The parallel adjacent lateral edges 54 are also curved towards the central axis between the major edges. The adjacent lateral edges 54 are parallel to each other and the scallop surface 52 between them is curved inwardly towards the central axis and concave as viewed from the outside of the device. The scallops 36 are obliquely angled to the major edges, specifically they are angled downward away from leading edge 30 to major edges 60 and 62. Major edge 31 is located opposite of the leading edge 30. As shown in FIGS. 5*a* and 5*b*, the scallops 36 are angled downward away from major edge 31. The oblique angle of one side is mirrored to adjacent sides 32, 34 and 33, 35. A plane of symmetry is formed by the leading edge 30 and major edge 31 along with a second plane of symmetry formed by left major edge 62 and right major edge 60. The scallops 36 are stacked with parallel adjacent lateral edges 54 of adjacent scallops in contact to form a continuous surface, creating major surfaces 32, 34, 33, and 35. Details of the scalloped surface are shown in FIG. 3. The angles of the scallops 36 shown on the device 10 are shown in FIGS. 1, 3, 4*a*, and 4*b*. Viewed from the side (as shown in FIGS. 5*a* and 5*b*), scallops 36 on the front surface 34 point downward and away from leading edge 30 and scallops 36 on the rear surface 35 point downward and away from major edge 31.

Figure 4A:
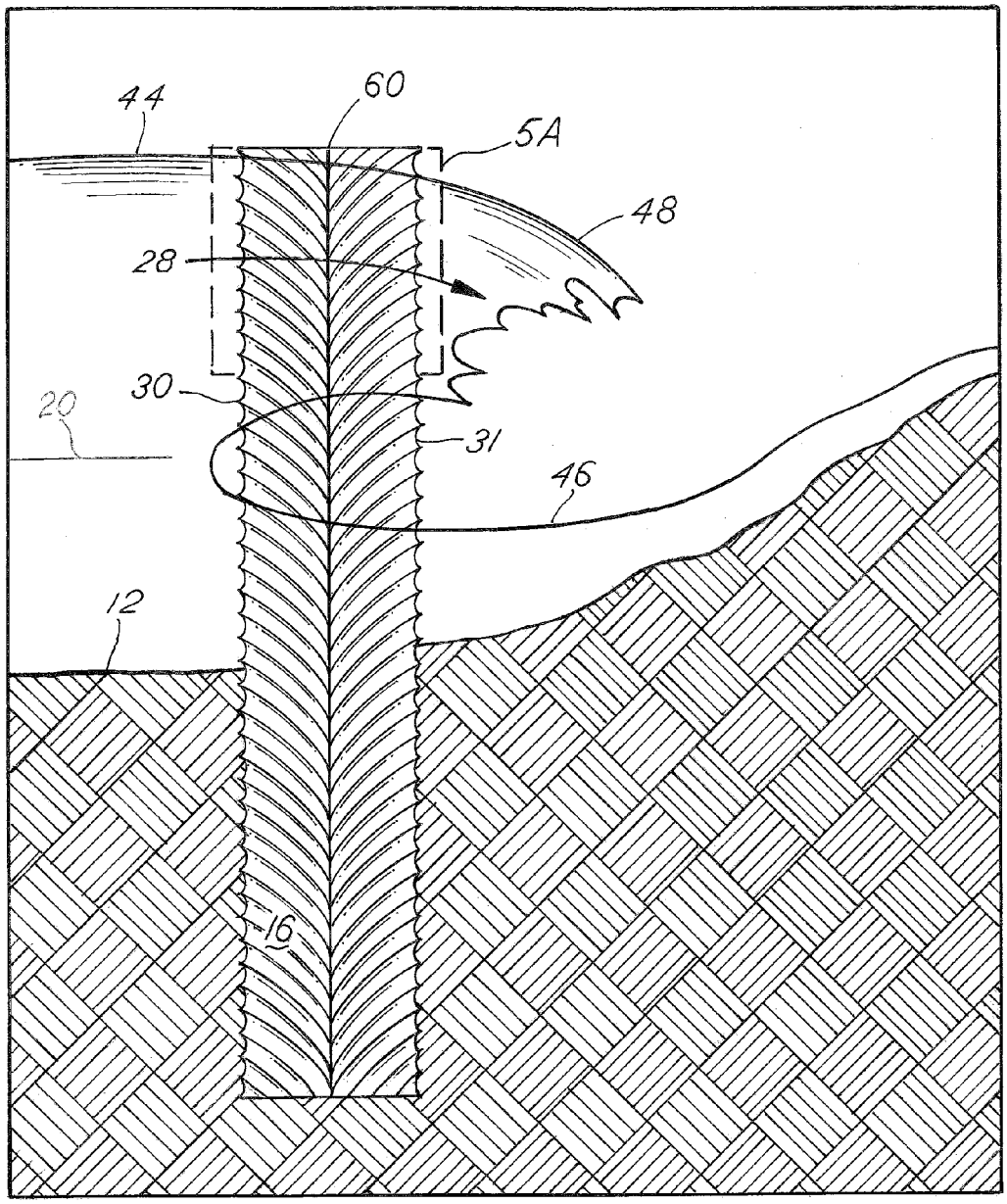
FIG. 4*a* is a side view of the device as a wave is making contact.
Figure 4B:
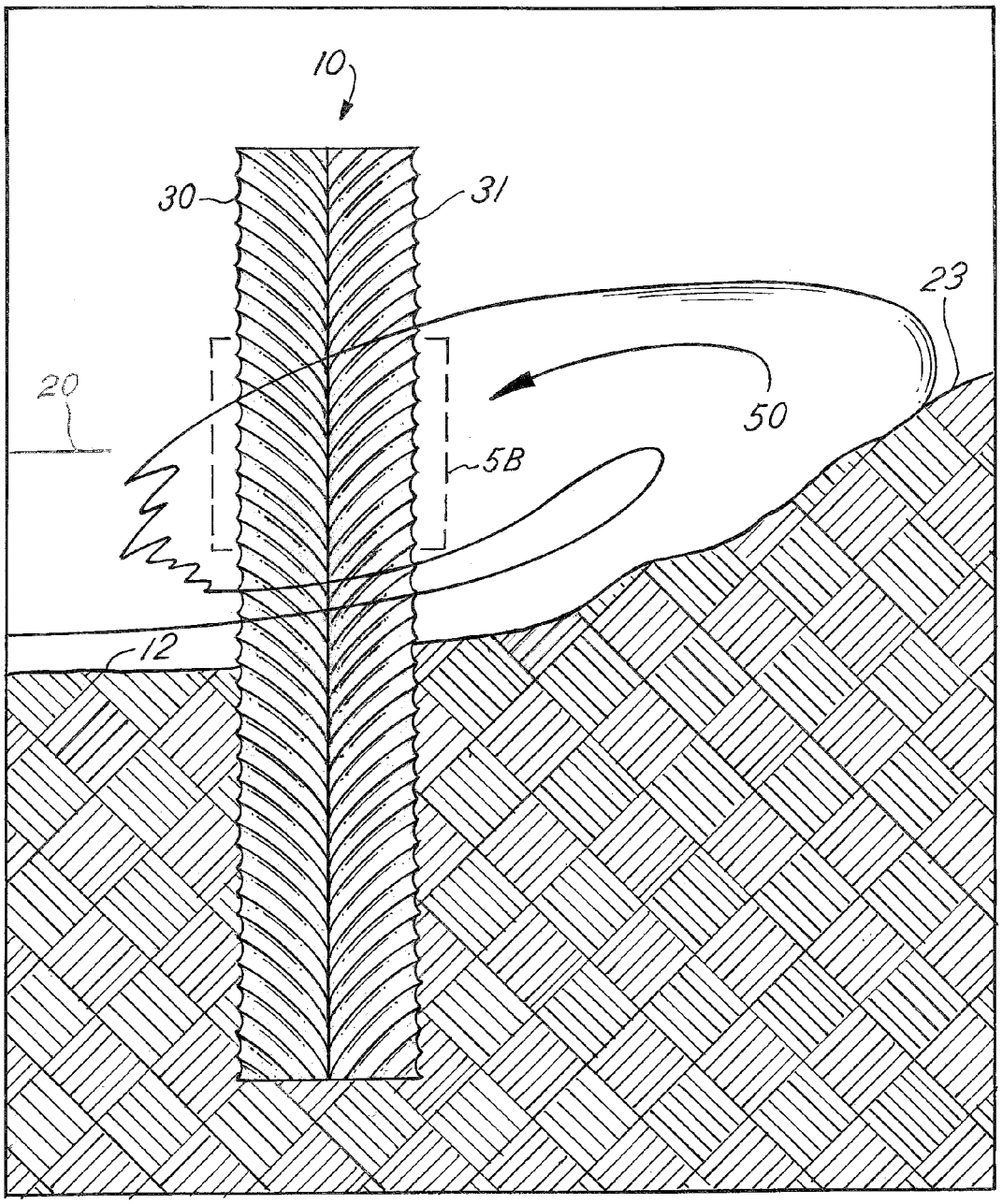
FIG. 4*b* is a side view of the device as a wave rebounds from the shore.
Figure 5A:
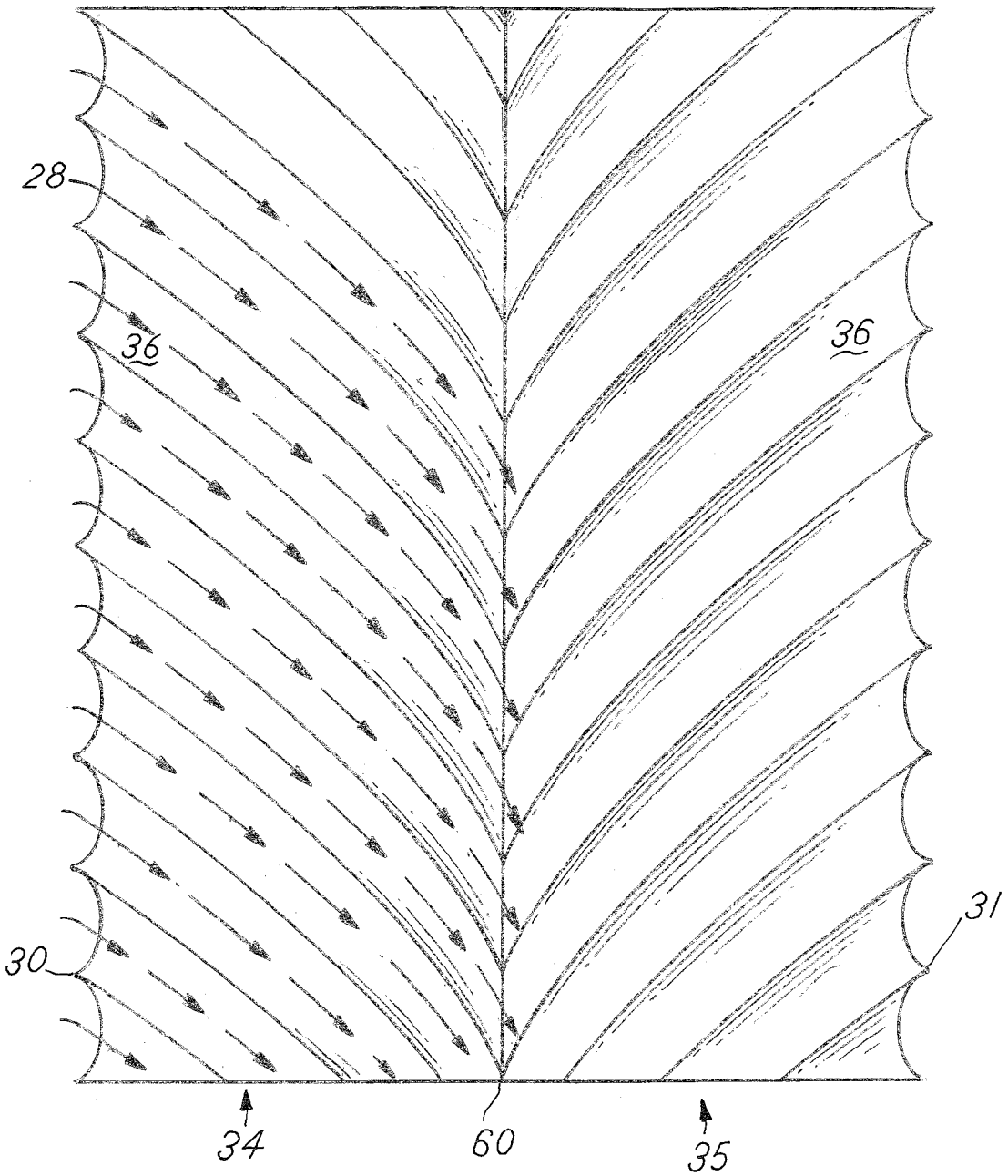
FIG. 5*a* is a side view of the device directing wave energy downward as a wave comes to shore.
Figure 5B:
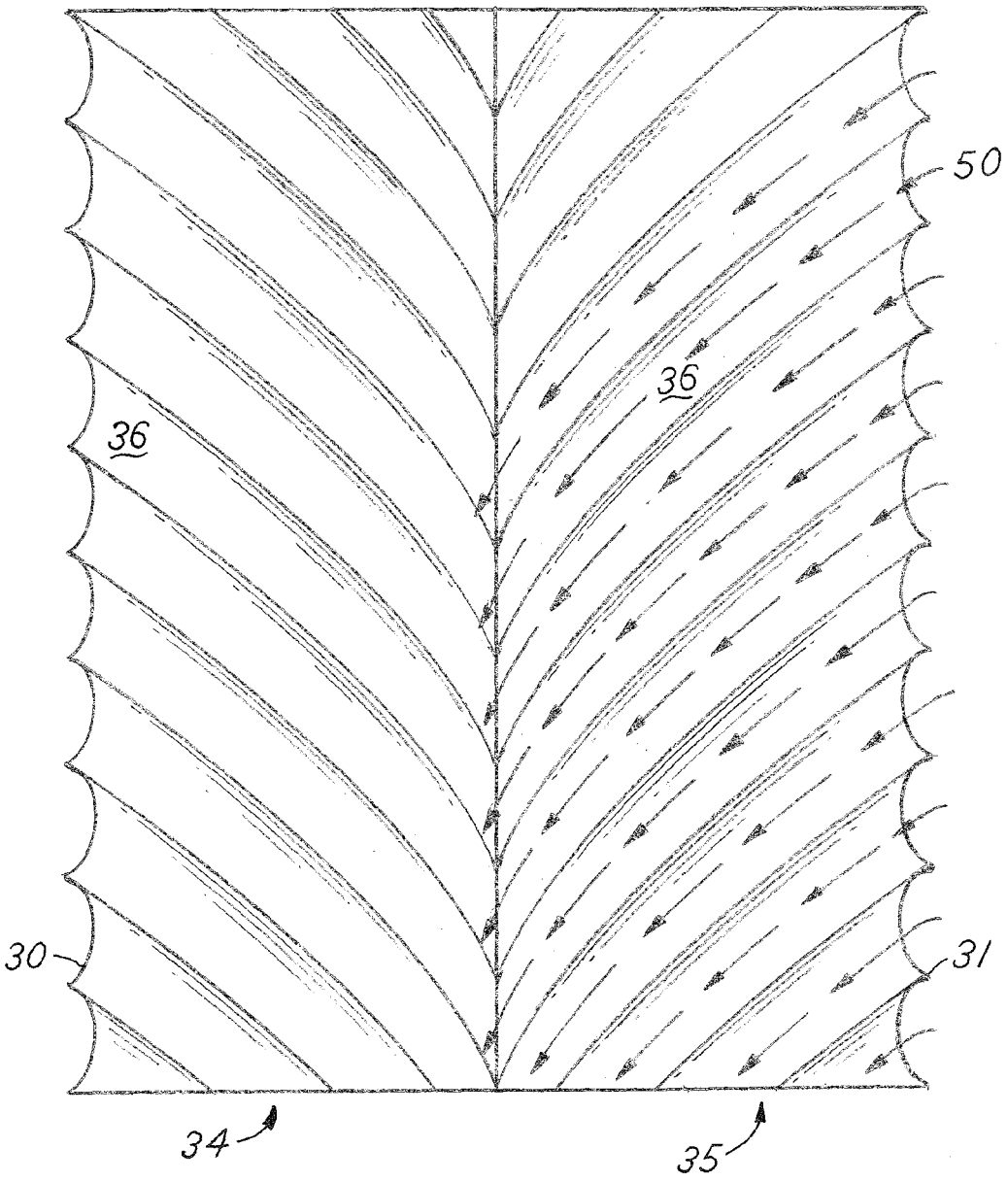
FIG. 5*b* is a side view of the device directing wave energy downward as a wave rebounds from the shore.

A wave 28, FIG. 4A, approaches a shore 26 with varying intensity, size and frequency. Waves 28 are formed by watercraft travel, turbulence, earthquakes, storms, underwater currents, wind, or other environmental factors. The wave 28 has a trough 46, a crest 44, and is measured in frequency and amplitude. As a wave 28 comes to shore 26, it breaks as shown in FIG. 4*a*. The way a wave breaks varies with the slope of the ground 12 under the water as it meets the shore 26. The wave breaks when the base of the wave can no longer support the top, causing the top to collapse, thereby releasing energy. This is shown in FIG. 4*a*. As the water rebounds from the shore 26, as shown in FIG. 4*b*, the rebound wave 50 causes the water to flow away from the shore 28 and back to the body of water 22.

FIG. 2 shows a multiple of the devices 10 mounted in proximity to a shore 26 of a body of water 22 and the wave force 38 as it impacts the front surface 32, 34. As shown in FIG. 2, the wave is split by the leading edge 30, directing any part of the wave force 38 that impacts front surface 32 to the left, and any part of the wave 28 that impacts front surface 34 to the right (as viewed from the body of water). This directs the force of the wave as it passes the device 10 to be more parallel to the shore 26 as shown with arrows 40. The front surfaces 32, 34 direct the wave force 38 downward in addition to directing it more parallel to the shore 26. Viewed from the side (as shown in FIGS. 4*a* and 4*b*), scallops 36 on the front surface 34 direct approaching waves 28 downward. Major surfaces 33 and 35 direct a rebound wave 50 downward. The concavity of the sides 32, 33, 34, 35 become an increasingly tight angle for the wave, more gradually transitioning the wave front from substantially perpendicular 38 to substantially parallel 40 to the shore 26. Further, the scallops 36 direct the wave downward as the water travels along the axis of the scallop 36.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A device for diffusing wave energy in a body of water with a shore and horizon, said device affixed in said body of water in proximity to said shore and substantially perpendicular to said horizon, said device comprising:

an enclosed elongate member having a central axis;

major edges parallel to and offset from said central axis, said major edges extending from a top to a bottom of said device, major surfaces cooperating to enclose said elongate member and located between adjacent major edges being formed by the intersection of adjacent major surfaces, said major surfaces defined by a series of adjacent scallops, each scallop having parallel adjacent lateral edges defining the width of said scallop and a scallop surface between said adjacent lateral edges, said scallop surface curved inwardly so that points intermediate to said adjacent lateral edges are nearer said central axis than said lateral edges, and said lateral edges curved inwardly so that points on said lateral edges intermediate to said major edges are nearer said central axis than points on said lateral edges nearest said major edges, said scallops being concave when viewed from the outside of said device, said major surfaces being concave when viewed from the outside of the device, said device adapted to be affixed in said body of water.

2. The device according to claim 1, said adjacent lateral edges obliquely angled with respect to a major edge.

3. The device according to claim 2, one of said major edges being a leading edge located nearer said shore than adjacent trailing edges, said lateral edges defining said scallops being nearer said bottom adjacent to said leading edge and relatively further from said bottom adjacent to said trailing edges.

4. The device according to claim 3, said device affixed in said body of water in proximity to said shore with said leading edge facing toward said horizon so that waves moving from said horizon toward said shore strike said leading edge of said device before reaching other said major edges.

5. The device according to claim 4, said device affixed in said body of water substantially perpendicular to a static waterline of said body of water.

6. The device according to claim 1, said device having four major edges and symmetrical about a plane formed by opposing major edges and said major edges being equally offset from said central axis.

7. The device according to claim 6, one of said major edges being a leading edge located nearer said shore than adjacent trailing edges, said lateral edges defining said scallops being nearer said bottom adjacent to said leading edge and relatively further from said bottom adjacent to said trailing edges.

8. A device for diffusing wave energy in a body of water with a shore and horizon, said device affixed in said body of water in proximity to said shore and substantially perpendicular to said horizon, said device comprising:

an elongate member having a central axis;

major edges extending from a top to a bottom of said device, major surfaces located between adjacent major edges being formed by the intersection of adjacent major surfaces, said major surfaces defined by a series of adjacent scallops, each scallop having adjacent lateral edges defining the width of said scallop and a scallop surface between said adjacent lateral edges, said scallop surface curved inwardly so that points intermediate to said lateral edges are nearer said central axis than said lateral edges, said scallops being concave when viewed from the outside of said device, said major surfaces being concave when viewed from the outside of the device, said device adapted to be affixed in said body of water.

9. The device according to claim 8, said adjacent lateral edges being substantially parallel.

10. The device according to claim 9, said adjacent lateral edges obliquely angled with respect to a major edge.

11. The device according to claim 10, one of said major edges being a leading edge located nearer said shore than adjacent trailing edges, said lateral edges defining said scallops being nearer said bottom adjacent said leading edge and relatively further from said bottom adjacent said trailing edges.

12. The device according to claim 8, said major edges parallel to said central axis and equally offset therefrom.

13. The device according to claim 12, said device having four major edges and symmetrical about a plane formed by opposing major edges.

14. The device according to claim 13, one of said major edges being a leading edge located nearer said shore than adjacent trailing edges, said lateral edges defining said scallops being nearer said bottom adjacent to said leading edge and relatively further from said bottom adjacent to said trailing edges.

15. The device according to claim 8, said device having four major edges and symmetrical about a plane formed by opposing major edges.

16. The device according to claim 8, said device adapted to be affixed in said body of water in proximity to said shore with said a leading edge facing away from said shore.

17. The device according to claim 16, said device affixed in said body of water substantially perpendicular to said horizon.

18. The device according to claim 17, said device protruding above said horizon in said body of water.

19. A device for diffusing wave energy in a body of water with a shore and horizon, said device affixed in said body of water in proximity to said shore and substantially perpendicular to said horizon, said device comprising:

an elongate member having a central axis;

major edges parallel to and offset from said central axis, said major edges extending from the top to the bottom of said device, a major surface located between adjacent major edges, said major surface defined by a series of scallops, each scallop having parallel adjacent lateral edges defining the width of said scallop and a scallop surface between said adjacent lateral edges said scallop surface and said lateral edges curved inwardly toward said central axis so that points intermediate to said lateral edges are nearer said central axis, points at the approximate midpoint between said adjacent lateral edges are nearer said central axis relative to said adjacent lateral edges, said scallops being concave when viewed from the outside of said device, said major surfaces being concave when viewed from the outside of the device, said device adapted to be affixed in said body of water, one of said major edges being a leading edge located nearer said horizon than adjacent trailing edges, said lateral edges defining said scallops being nearer said bottom adjacent said leading edge and relatively further from said bottom adjacent said trailing edges.

20. The device according to claim 19, said device having four major edges and symmetrical about a plane formed by opposing major edges.

* * * * *